US005725186A

United States Patent [19]

Hillstrom et al.

[11] Patent Number: 5,725,186

[45] Date of Patent: Mar. 10, 1998

[54] UNIVERSAL FLEXIBLE SIGN MOUNTING DEVICE

[75] Inventors: David U. Hillstrom, Novi; James J. Mason, Northville, both of Mich.

[73] Assignee: Marketing Displays, Inc., Farmington Hills, Mich.

[21] Appl. No.: 780,538

[22] Filed: Jan. 9, 1997

Related U.S. Application Data

[63] Continuation of Ser. No. 382,292, Jan. 31, 1995, abandoned.

[51] Int. Cl.[6] ..... F16M 11/00

[52] U.S. Cl. ..... 248/176.1; 248/121; 248/624; 40/606; 40/607

[58] Field of Search ..... 248/176.1, 158, 248/160, 121, 122.1, 125.2, 163.1, 218.4, 219.2, 219.3, 219.1, 219.4, 413, 623, 624; 40/603, 606, 608, 610, 612

[56] References Cited

U.S. PATENT DOCUMENTS

| | | | |
|---|---|---|---|
| 2,702,139 | 2/1955 | Faustine | 248/58 |
| 3,102,352 | 9/1963 | White | 248/219.2 |
| 3,899,843 | 8/1975 | Doyle et al. | 40/612 |
| 4,288,053 | 9/1981 | Sarkisian | 248/218.4 |
| 4,309,836 | 1/1982 | Knapp | 40/602 |
| 4,544,125 | 10/1985 | Seely | 248/624 |
| 5,152,091 | 10/1992 | Leach | 40/603 |
| 5,318,258 | 6/1994 | Lang | 248/166 |
| 5,472,162 | 12/1995 | Mason | 248/121 |

*Primary Examiner*—Leslie A. Braun
*Assistant Examiner*—Anita M. King
*Attorney, Agent, or Firm*—Brooks & Kushman

[57] ABSTRACT

Adapter bracket mechanisms for securing various roll-up signs to a sign stand. The bracket mechanisms are positioned vertically upright from the base of a sign stand. The adapter bracket mechanisms hold the lower end of the vertical cross brace of the roll-up sign. The mechanisms include a U-shaped channel and either a slide bar or pivoting lever arm member for enclosing the cross brace within the channel. A threaded turn-lock member securely holds the sign in the adapter bracket mechanism. If desired, a protector member can be used to help hold the vertical cross brace in the bracket mechanism and protect the cross brace from possible damage. Another embodiment utilizes a threaded knob to wedge the vertical cross brace in the channel.

8 Claims, 6 Drawing Sheets

UNIVERSAL FLEXIBLE SIGN MOUNTING DEVICE

This is a continuation of application Ser. No. 08/382,292 filed on Jan. 31, 1995, now abandoned.

TECHNICAL FIELD

The present invention relates to signs and sign stands and more particularly to adapter devices for allowing use of different signs for sign stands.

BACKGROUND OF THE INVENTION

There are numerous uses for signage products today, particularly for advertising and promotion of products and services of various businesses, as well as for warning and information signs along construction sites and the like. Many of these signage products use sign stands or sign holders of various types for holding and displaying signs, which also can be various shapes, types and sizes.

A number of sign stands and sign holders use an upright that is attached to a base by a resilient member. The base has a number of ground engaging leg members, which can be telescopic.

A number of signs are used for these devices, most either being flexible roll-up type signs or rigid-type signs. The rigid signs are typically attached to the upright by various types of mounting brackets which are releasably secured to the upright or sign stand. The roll-up signs typically have a pair of cross braces attached to a flexible sheet of vinyl material.

When the cross braces of the roll-up signs are deployed in an "X" or cross-shaped configuration, the sign panel is attached at its corners to the ends of the cross braces. The sign panels can be attached to the ends of the cross braces in various ways, such as by twist lock fasteners, VELCRO hook-and-loop type fasteners, snaps, plastic pockets, or stretchable elastic straps. Fasteners of the latter type are marketed by Marketing Displays, Inc. of Farmington Hills, Mich. under the trademark Duralatch elastic straps.

There are a number of different kinds and types of signs made by a number of different manufacturers. As a result, it is often difficult to mix and match signs of one company with sign stands or sign holders of other companies. Although there are some adapters available to allow use of signs of one manufacturer with sign stands and sign holders of other manufacturers, they have limited use and applicability.

SUMMARY OF THE INVENTION

It is an object of the present invention to provide improved systems for holding signs of various types to a sign holder or sign stand. It is another object of the present invention to provide adapter devices which allow use of various roll-up signs with a sign stand.

It is also an object of the present invention to provide adapter brackets which allow use of various roll-up signs with a sign stand having an upright of limited height.

These and other objects are accomplished by the present invention. The present invention provides adapter devices and sign stands which can securely hold and display various roll-up type signs of numerous manufacturers. An adapter bracket is attached to the upper end of the sign stand upright and has a U-shaped channel for holding the vertical cross brace of a roll-up sign. The U-shaped channel member fits around the upright and a slide bar or pivoting lever is used to secure the bracket to the cross brace. A turn screw is used to securely hold the vertical cross brace in the bracket. A plate or protective member can be used to prevent damage to the vertical cross brace.

An alternative adapter bracket holds the cross brace upright in place by gripping it from the sides.

These and other objects, features and advantages of the invention will become apparent from the following description when viewed in accordance with the accompanying drawings and appended claims.

BEST MODE (S) FOR CARRYING OUT THE INVENTION

Figure 2:
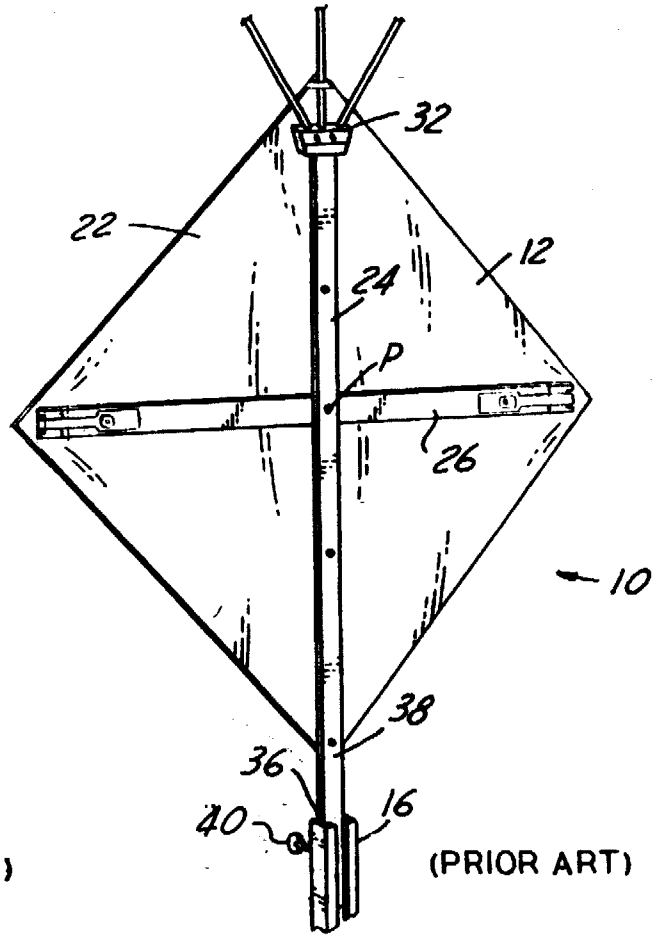
(PRIOR ART) FIG.2
FIGS. 1 and 2 depict the front and rear views, respectively, of a sign and sign stand.
Figure 1:
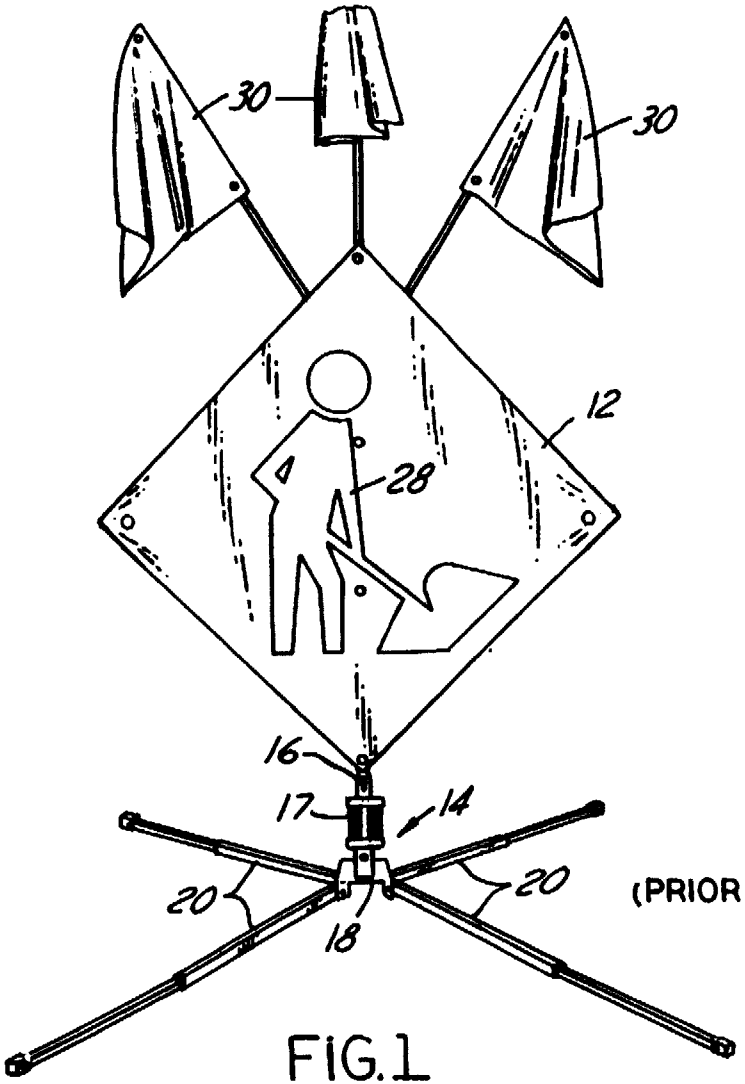
(PRIOR ART) FIG.1
Figure 3:
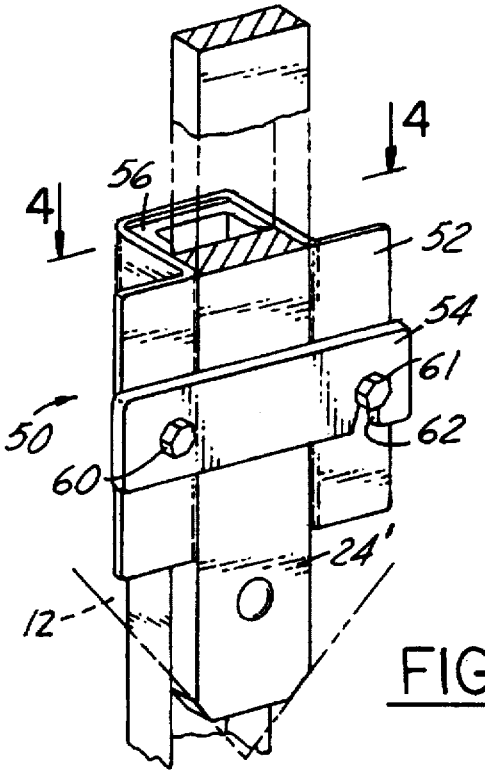
FIG. 3 is a perspective view of one embodiment of the present invention.
Figure 4:
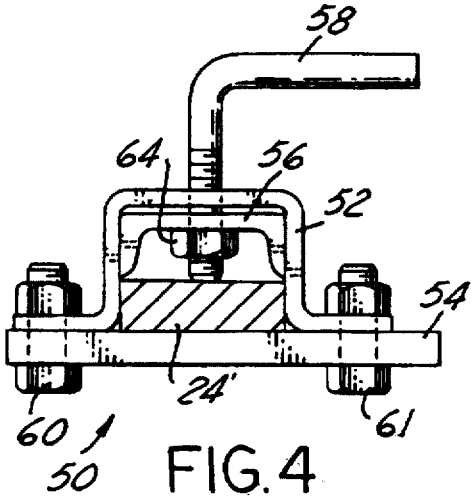
FIG. 4 is a cross-sectional view of the present invention taken along lines 4—4 in FIG. 3 and in the direction of the arrows.

FIGS. 1 and 2 illustrate a conventional sign and sign stand. These are referred to generally by the reference numeral 10. The sign stand system includes a roll-up sign 12 and a sign stand or sign holder 14. The sign stand has a vertical upright 16, a base member 18 and a pair of coil springs 17 connecting the upright to the base. A plurality of ground engaging legs 20 are attached to the base member. Preferably four legs are provided and are telescopic for ease of transport and storage.

Sign stands of this type are shown, for example, in U.S. Pat. Nos. 4,548,379 and 4,572,473.

Other types of resilient members, that is other than coil springs 17, could be utilized for attaching the vertical upright member 16 to the base member 18.

The sign 12 is a roll-up type sign. A flexible sign panel 22 preferably made of vinyl is attached to a pair of cross brace members 24 and 26. Preferably the cross brace members 24 and 26 are made from a fiberglass material and are pivotally attached to each other at point P. The sign panel 22 has a design or indicia 28 of some type on the front surface.

The sign panel 22 is attached to the cross brace members at the corners. In this regard, the sign panel 22 can be attached to the cross brace members 24, 26 in a number of different ways, such as by twist lock fasteners, VELCRO hook-and loop type fasteners, snaps, plastic pockets or stretchable elastic strap members. The latter type of fasteners are shown in FIGS. 1 and 2 and are available from Marketing Displays, Inc., Farmington Hills, Mich. under the name DURLATCH elastic straps.

If desired, a plurality of flags 30 can be secured to the sign 12, such as by means of bracket member 32 which is secured to the upper end of the vertical cross brace 24.

The upright 16 of the sign stand 14 is of limited height (approximately 20–24 inches) and has one or more elongated channels 36 for holding the sign. The lower end 38 of vertical cross brace member 24 fits within the channel 36 and is held in place by a latch pin or lock pin 40. The pin 40 fits through mating openings in the upright 16 and the end 38 of the vertical cross brace. Sign stands of this type are available from Marketing Displays under the names "System 3" and "TrafficMaster".

The upright on the sign stand 14 shown in FIGS. 1 and 2 positions and displays signs marketed by Marketing Displays very satisfactorily. However, difficulties have developed in attempting to position signs marketed by other manufacturers in such sign stands. Often, the signs do not have an extension on the lower end of the vertical cross brace for mating with channel 36, or have a fastening mechanism on the lower end of the vertical cross brace which prevents the vertical cross brace from being properly positioned in channel 36.

The present invention provides a unique sign stand, upright and adapter bracket which securely holds and displays virtually all known signs of various manufacturers, regardless of the manner in which the sign panels are attached to the cross braces.

One embodiment of the present invention is shown in FIGS. 3–6. An adapter bracket 50 is adapted to hold a vertical upright 24' of a roll-up sign. The portion of upright 24' shown is the lower end of the vertical cross brace. Bracket 50 has a U-shaped channel member 52, a lever arm member 54, turn lock handle 58 and a pair of nuts and bolts or other fasteners 60 and 61.

The bracket 50 is welded or otherwise securely affixed to vertical upright member 56 of the sign stand. The upright 56 has a limited height and is attached to a resilient mechanism, such as a pair of coil springs, which in turn are attached to a base with a plurality of legs.

Figure 5:
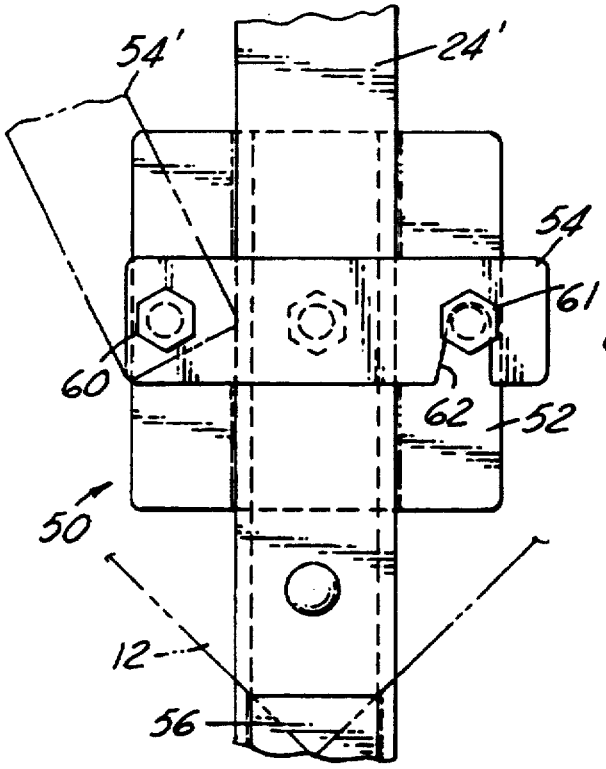
FIGS. 5 and 6 are front and side elevational views, respectively, of the embodiment of the invention shown in FIGS. 3 and 4.
Figure 6:
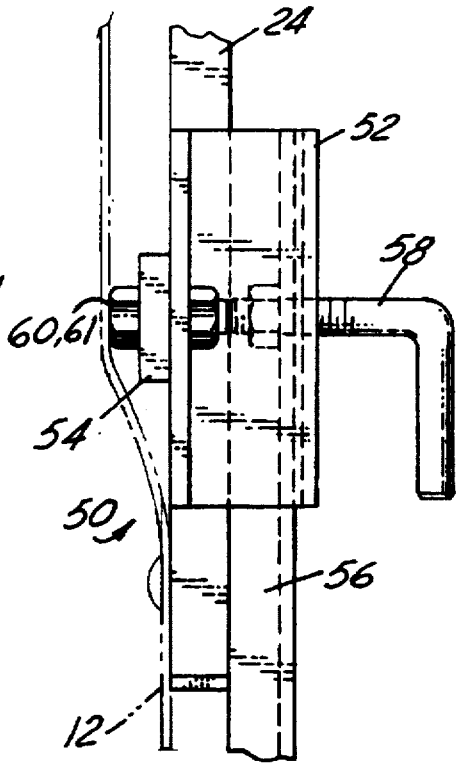

In order to position the adapter bracket 50 on the vertical cross brace 24', the lever arm member 54 is pivoted around fastener 60 to the position 54' shown in FIG. 5. Then, after the cross brace 24' of the sign is positioned in the U-shaped bracket 52, the lever member 54 is rotated to its locked position as shown in FIGS. 3–6. For this purpose, the lever arm member 54 has a slot 62 which fits over the shaft of fastener 61.

The cross brace 24' is forced into contact with the rear of the lever arm member by the L-shaped turn-lock member 58. A nut 64 is welded or otherwise secured to upright member 56 and facilitates rotation of the lever arm member 58 and thus tightening of the cross brace 24' against the member 54.

Another embodiment of the present invention is shown in FIGS. 7–11. This adapter bracket mechanism 70 includes a pair of side bracket members 71 and 72, a slide bar member 74, a pair of retainer pin members 76, an L-shaped turn-lock member 58' and a protector member 80. The bracket members 71 and 72 are welded or otherwise affixed to vertical upright member 56' forming a generally U-shaped channel 75.

Figure 7:
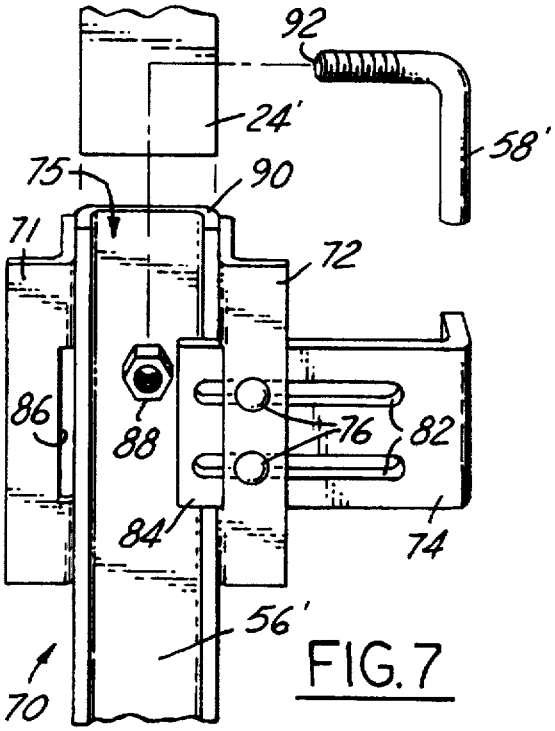
FIG. 7 is a perspective view of another embodiment of the present invention.
Figure 8:
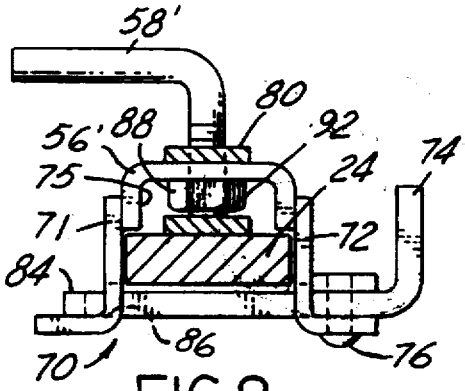
FIG. 8 is a cross-sectional view of the present invention taken along lines 8—8 in FIG. 10 and in the direction of the arrows.
Figure 9:
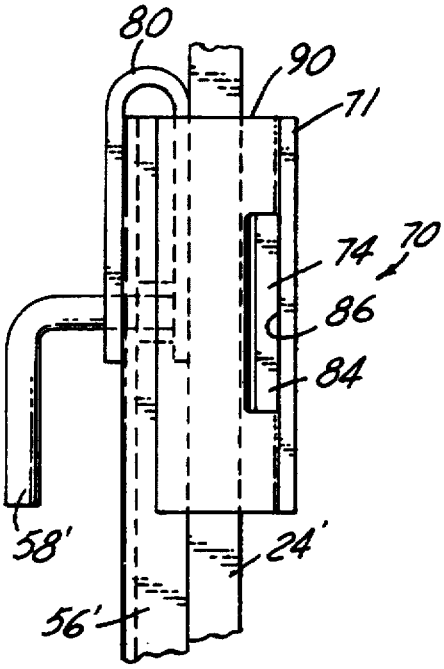
FIGS. 9 and 10 are side and front elevational views, respectively, of the embodiment of the invention shown in FIGS. 7 and 8.
Figure 10:
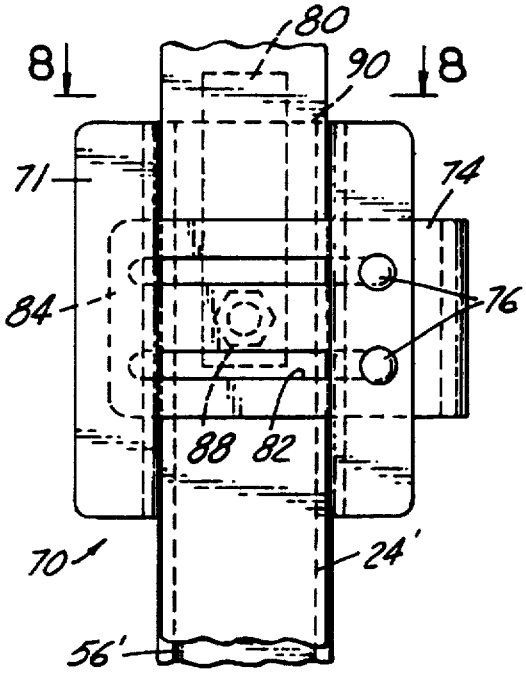

The bracket mechanism 70 is positioned around the lower end of a vertical cross brace member 24' of a roll-up sign. In order to accommodate this, slide bar member 74 is slid to its open position as shown in FIG. 7. A pair of slots 82 in the slide bar member 74 allow member 74 to slide relative to the side bracket member 72 and pins 76. When the slide bar member 74 is in its closed position, as shown in FIGS. 8–10, the leading edge 84 is positioned through slot 86 in the side bracket member 71.

The turn-lock 58' is similar to member 58 described above and is attached to the vertical uprights 56' by a nut or fastener 88 which is welded or otherwise secured to upright 56'. Protective member 80 is positioned over the upper edge 90 of upright 56' and protects the vertical upright 24' from being damaged by the end 92 of the turn-lock member 58'.

Figure 11:
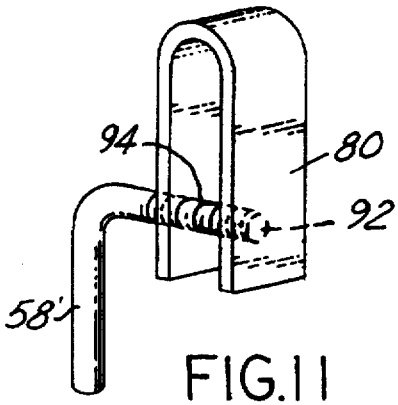
FIG. 11 depicts a protector member particularly used with the embodiment of the invention shown in FIGS. 8–10.

As shown in FIG. 11, the protective member 80 is attached to turn-lock member 58' by positioning member 58' through opening or hole 94. Preferably, the protective member 80 is made from a non-metallic material, such as plastic, in order to prevent damage to the vertical upright 24'.

Figure 12:
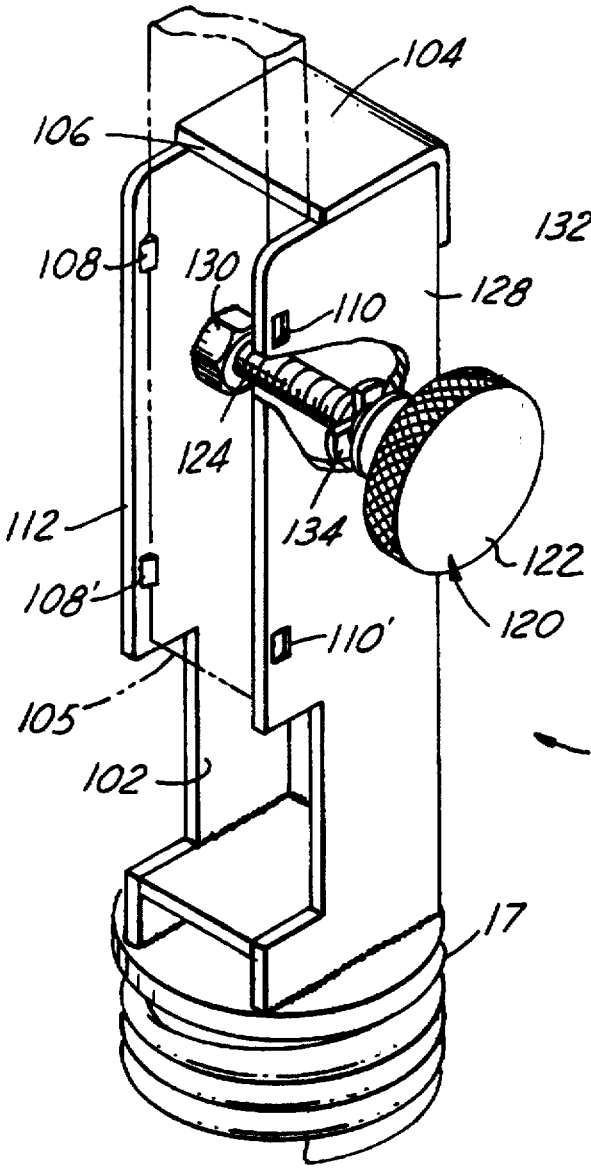
FIG. 12 is a perspective view of an alternative embodiment of the invention.
Figure 13:
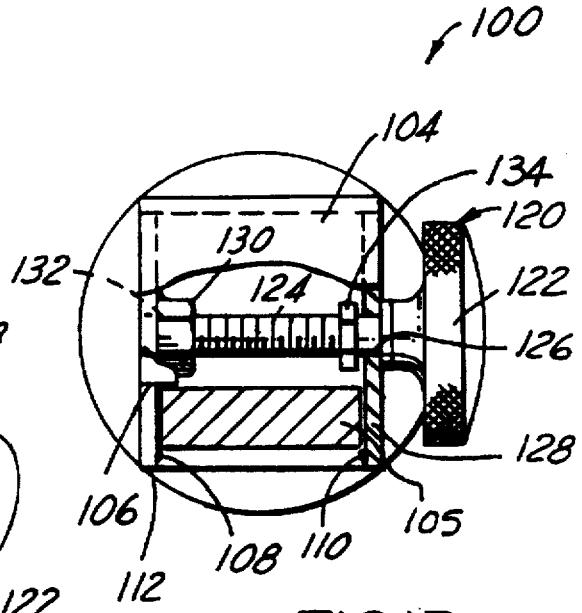
FIG. 13 is a top view of the invention shown in FIG. 12.

FIGS. 12 and 13 depict another embodiment of the present invention. In this bracket embodiment 100, a U-shaped channel 102 is welded or otherwise affixed in a vertically upright position, as shown. The channel 102 can be welded directly to the top of one of the coil springs 17, or to a short extension or bracket (not shown).

A plate member 104 is welded or otherwise affixed to the open top of channel 102 to prevent dirt and other debris from entering the channel and also to hold the upright cross brace 105 in position. The front edge 106 of top plate member 104 assists in holding upright 105 in position.

One or more pairs of projections 108 and 110 are formed adjacent front edge 112 of channel 102. Two pairs of projections (108, 110 and 108', 110') are shown, but any number can be provided. The projections, together with edge 106 of plate member 104 hold the cross brace 105 vertically upright.

Once the cross brace 105 is positioned in the channel 102, threaded knob 120 is used to hold the cross brace firmly in position. The knob 120 has a handle 122 attached to a threaded rod 124. The rod is positioned through opening or hole 126 in the side member 128 of channel 102 and threaded in nut or fastener 130 welded or otherwise secured on inside side member 132. Snap ring 134 holds the knob 120 from being separated from the channel 102.

When it is desired to hold the cross brace 105 in the bracket 100, the knob 120 is turned until the side members 128 and 132 tightly press against the sides of upright 105 and wedge or squeeze it tightly in place. When it is desired to remove the upright 105, the knob 120 is turned or rotated in the opposite direction.

Figure 14:
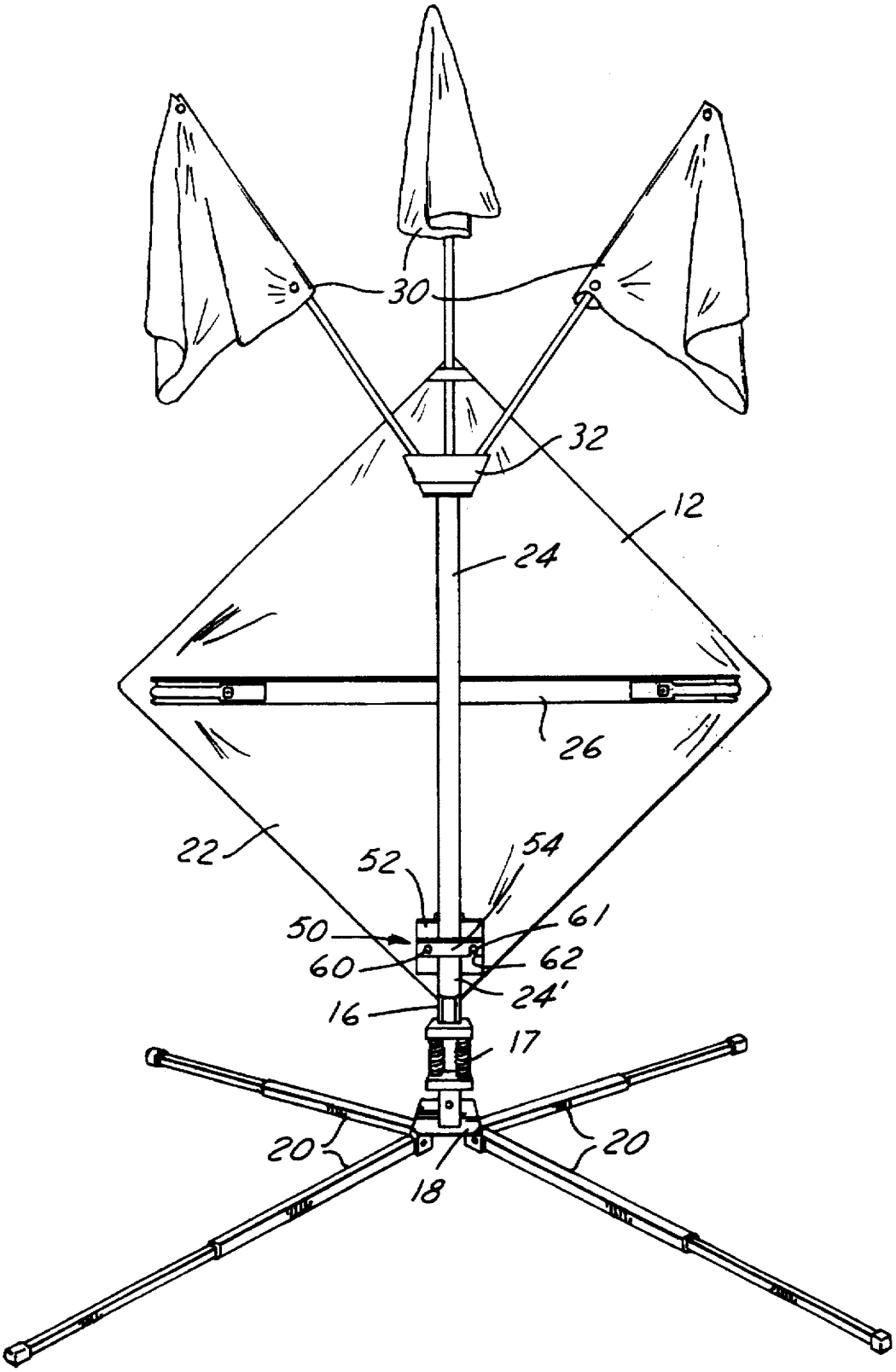
FIGS. 14, 15 and 16 illustrate use of the bracket embodiments of the present invention to secure a sign to a sign stand.
Figure 15:
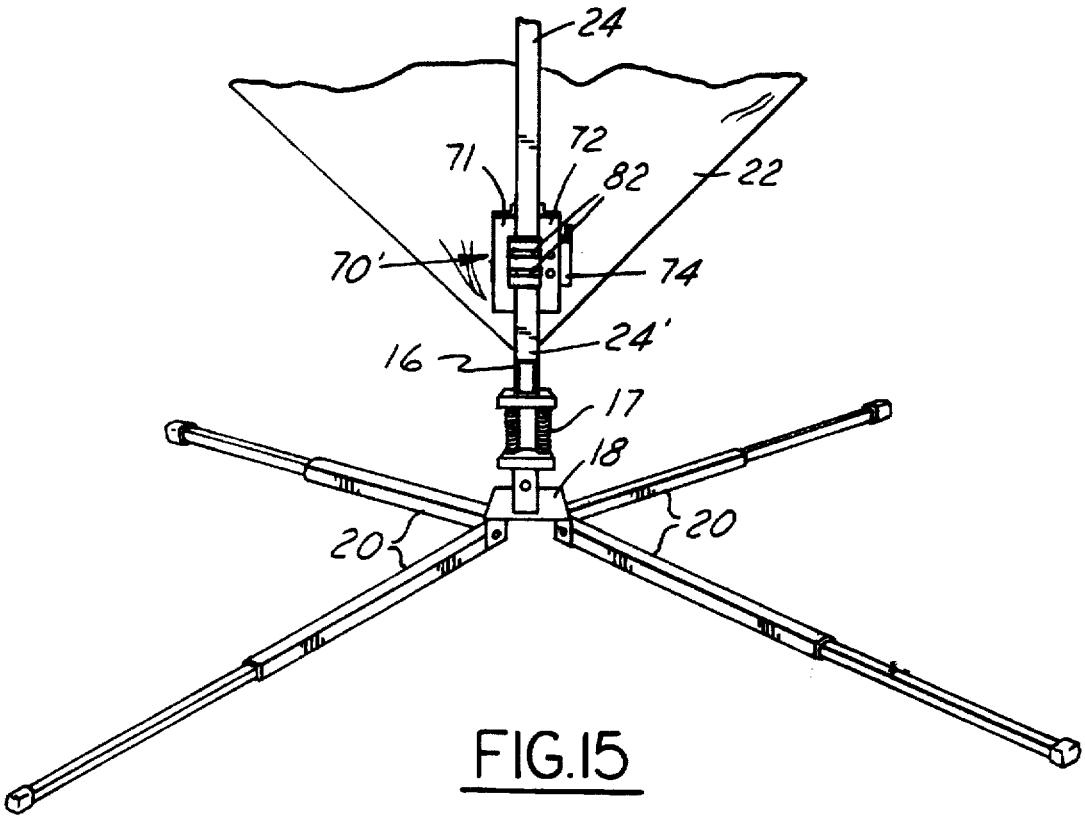
Figure 16:
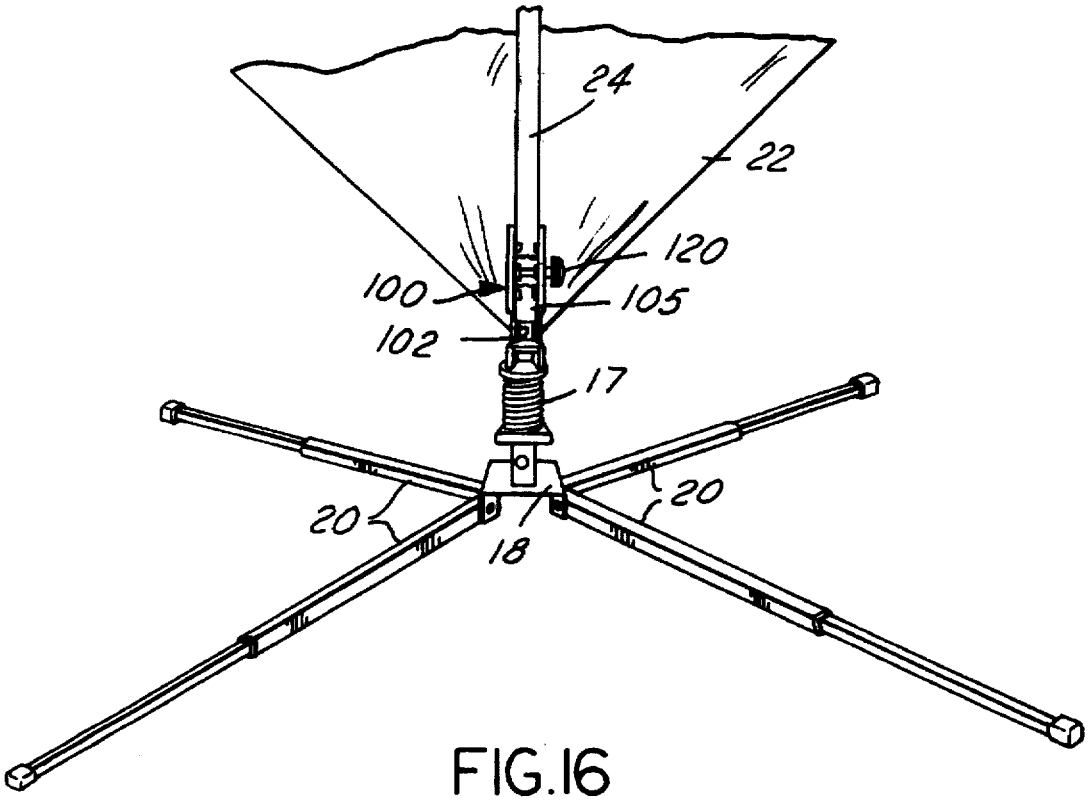

FIGS. 14, 15 and 16 illustrate the use of bracket mechanisms 50, 70 and 100, respectively, to secure roll-up signs to sign stands. The sign stands have base members 18, leg members 20, coil springs 17 and upright members 16. The signs 12 have sign panels 22 and vertical cross braces 24.

Preferably, all of the components of the two embodiments of the present invention described above are made from a durable material such as steel or other metal material, with the exception of protective member 80.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

What is claimed is:

1. A bracket mechanism for holding a sign to a sign stand, the sign having a vertically oriented cross-brace member, said bracket mechanism comprising:

a rear panel member having 9 first vertically oriented elongated edge and a second vertically oriented elongated edge;

a first side panel member attached to said first elongated edge;

a second side panel member attached to said second elongated edge;

said rear panel member and said first and second elongated edges forming a generally U-shaped channel member with an open side adapted to receive a portion of the vertically oriented cross-brace member;

a first flange member attached to said first side panel member;

a second flange member attached to said second panel member;

an arm member having two ends and being positioned across said open side of said U-shaped channel member, a first end of said arm member being pivotably attached to said first flange member, and the second end of said arm member being releasably connected to said second flange member; and a locking member in operative association with said U-shaped channel member for tightly securing said portion of said vertically oriented cross-brace member in said bracket mechanism.

2. The bracket mechanism of claim 1 wherein said first and second flange members are positioned substantially parallel to said rear panel member.

3. The bracket member of claim 1 wherein said arm member has notch means adjacent said second end and said second flange member has a post member thereon, wherein said arm member is connected to said second flange member when said notch means is mated with said post member.

4. The bracket mechanism of claim 1 wherein said locking member comprises a turn-lock member rotatably attached to said rear panel member; said turn-lock member frictionally securing said portion of said vertically oriented cross-brace member against said arm member.

5. A sign stand for holding and displaying roll-up signs having a vertically oriented cross-brace member, the sign stand comprising:

a base member with a plurality of ground engaging leg members;

an upright member attached to said base member; and a bracket mechanism attached to the upright member, said bracket member comprising:

rear panel member having 9 vertically oriented elongated edge first and a second vertically oriented elongated edge;

a first side panel member attached to said first elongated edge;

a second side panel member attached to said second elongated edge;

said rear panel member and said first and second elongated edges forming a generally U-shaped channel member with an open side adapted to receive a portion of the vertically oriented cross-brace member;

a first flange member attached to said first side panel member;

a second flange member attached to said second panel member;

an arm member having two ends and being positioned across said open side of said U-shaped channel member, a first end of said arm member being pivotably attached to said first flange member, and the second end of said arm member being releasably connected to said second flange member; and a locking member for tightly securing said portion of said vertically oriented cross-brace member in said U-shaped channel.

6. The bracket mechanism of claim 5 wherein said first and second flange members are positioned substantially parallel to said rear panel member.

7. The bracket member of claim 5 wherein said arm member has a recess adjacent said second end and said second flange member has a post member thereon, wherein said arm member is connected to said second flange member when said recess is mated with said post member.

8. The bracket mechanism of claim 5 wherein said locking member comprises a turn-lock member rotatably attached to said rear panel member, said turn-lock member frictionally securing said portion of said vertically oriented cross-brace member against said arm member.

* * * * *